US009731414B2

(12) United States Patent
Ktytor

(10) Patent No.: US 9,731,414 B2
(45) Date of Patent: Aug. 15, 2017

(54) STORAGE SHEET HAVING A PLURALITY OF POCKETS

(71) Applicant: Tyler Lee Ktytor, Bismarck, ND (US)

(72) Inventor: Tyler Lee Ktytor, Bismarck, ND (US)

( * ) Notice: Subject to any disclaimer, the term of this patent is extended or adjusted under 35 U.S.C. 154(b) by 0 days.

(21) Appl. No.: 14/449,469

(22) Filed: Aug. 1, 2014

(65) Prior Publication Data

US 2016/0031606 A1 Feb. 4, 2016

(51) Int. Cl.
*B65D 30/22* (2006.01)
*B25H 3/00* (2006.01)

(52) U.S. Cl.
CPC ..... *B25H 3/00* (2013.01); *B65D 31/12* (2013.01)

(58) Field of Classification Search
USPC ..... 383/39; 206/0.84
See application file for complete search history.

(56) References Cited

U.S. PATENT DOCUMENTS 3,187,903 A * 6/1965 Oltz ..... A47F 7/146 211/88.01
3,967,666 A * 7/1976 Farrar ..... A61G 7/0503 383/39
4,825,584 A * 5/1989 Raley ..... A01K 97/06 43/57.1

* cited by examiner

*Primary Examiner* — Christopher Demeree
(74) *Attorney, Agent, or Firm* — John D. Veldhuis-Kroeze; Westman, Champlin & Koehler, P.A.

(57) ABSTRACT

A storage sheet having a plurality of pockets which includes a flexible sheet, a plurality of pocket strips, and a fastener. The plurality of pocket strips allow for the storage of personal or professional items. The plurality of pocket strips are shingled to save space as well as to display the contents of the pockets. The storage sheet is flexible to able to be rolled and secured or bundled together through use of the fastener. A roll-up storage sheet provides increased storage space as well as reduces the total volume the storage space occupies.

16 Claims, 8 Drawing Sheets

STORAGE SHEET HAVING A PLURALITY OF POCKETS

FIELD OF THE INVENTION

The present invention relates generally to a roll-up storage sheet having a plurality of pocket strips. More specifically, the present invention relates to a storage container that provides a space saving means for contents secured within the plurality of pocket strips.

BACKGROUND OF THE INVENTION

Mobile organizational containers are necessary for various professions. The ability to view and access tools, parts, and components quickly and efficiently is generally considered to be an asset to these professions. One such profession or hobby is fishing. Fishermen need to be able to choose the right lures to attract the desired catch. Lures are generally stored in tackle boxes or segmented compartment containers. When stored in traditional tackle boxes, lures become tangled and difficult to dislodge without having a hook pierce the skin of the user. The segmented containers provide compartments which single lures may be placed; however, by providing individual compartments for lures, the volume of space the container occupies increases greatly. The rectangular prism shape limits the placement of the containers while on a fishing vessel as well as the ability to carry a large amount of lures by a single person.

The present invention seeks to eliminate these issues for a container to store fishing lures or other objects in a space saving and efficient manner. The flexible nature of the present invention allows for the storage of the contents to be bundled into a cylindrical shape reducing the volume of storage space needed for the contents. A plurality of pocket strips provides individual storage compartments for contents to be contained within. For applications of fishing the present invention may be stored alongside rods and reels due to the cylindrical shape in the rolled configuration.

DETAIL DESCRIPTIONS OF THE INVENTION

All illustrations of the drawings are for the purpose of describing selected versions of the present invention and are not intended to limit the scope of the present invention.

Figure 5:
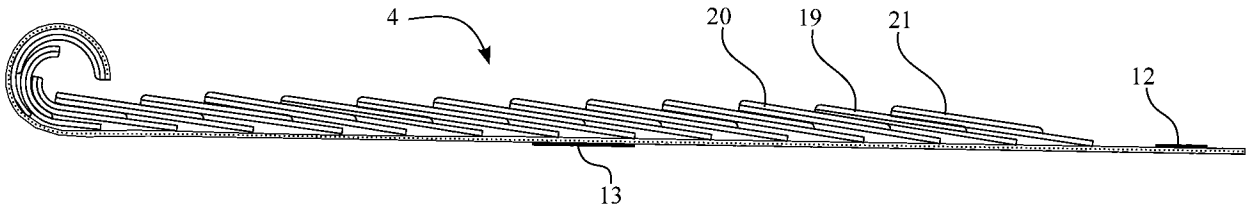
FIG. 5 is a horizontal side view detailing the flexibility of the present invention.
Figure 6:
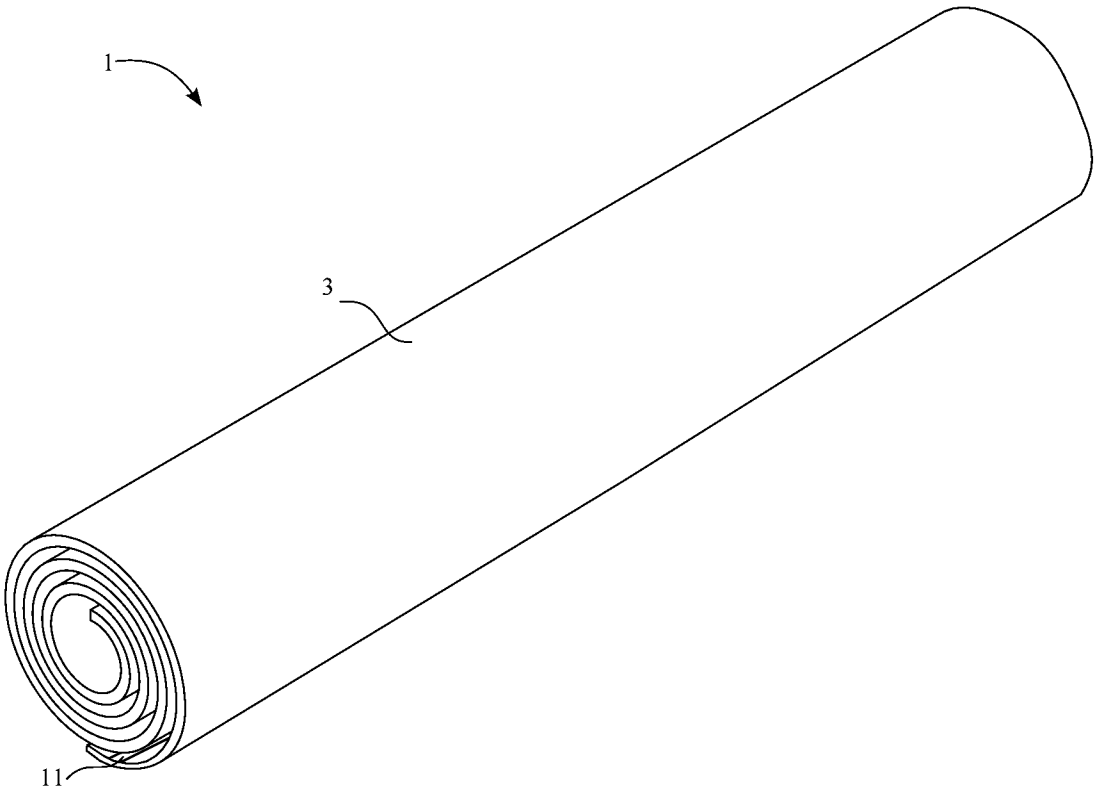
FIG. 6 is a perspective view of the present invention in a rolled configuration.
Figure 7:
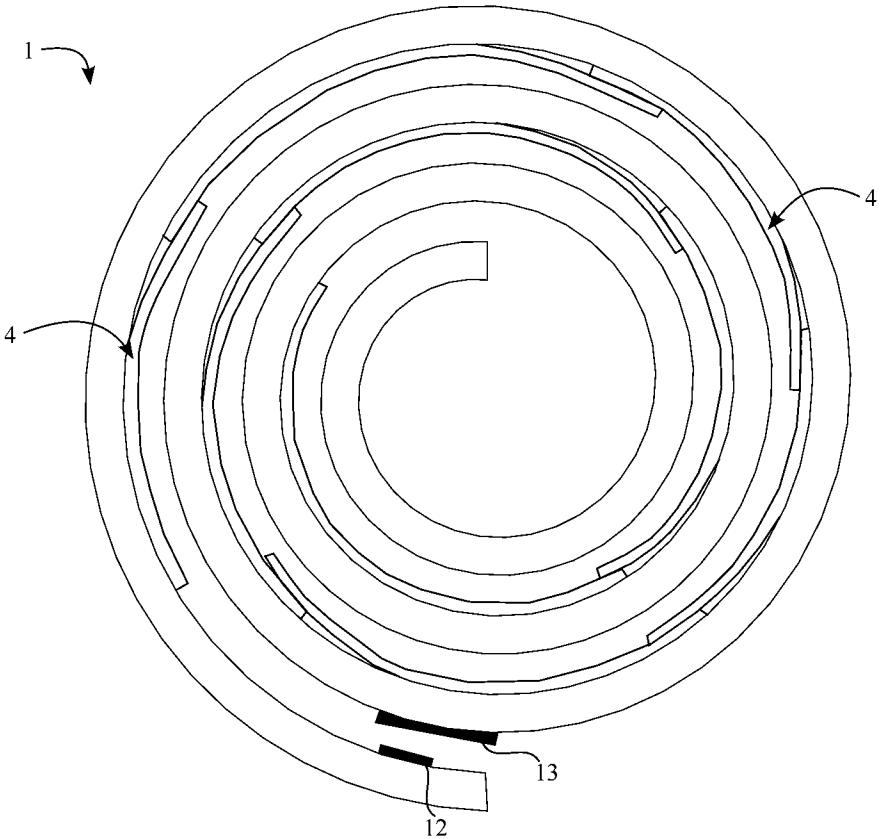
FIG. 7 is a side view of the present invention in a rolled configuration.
Figure 8:
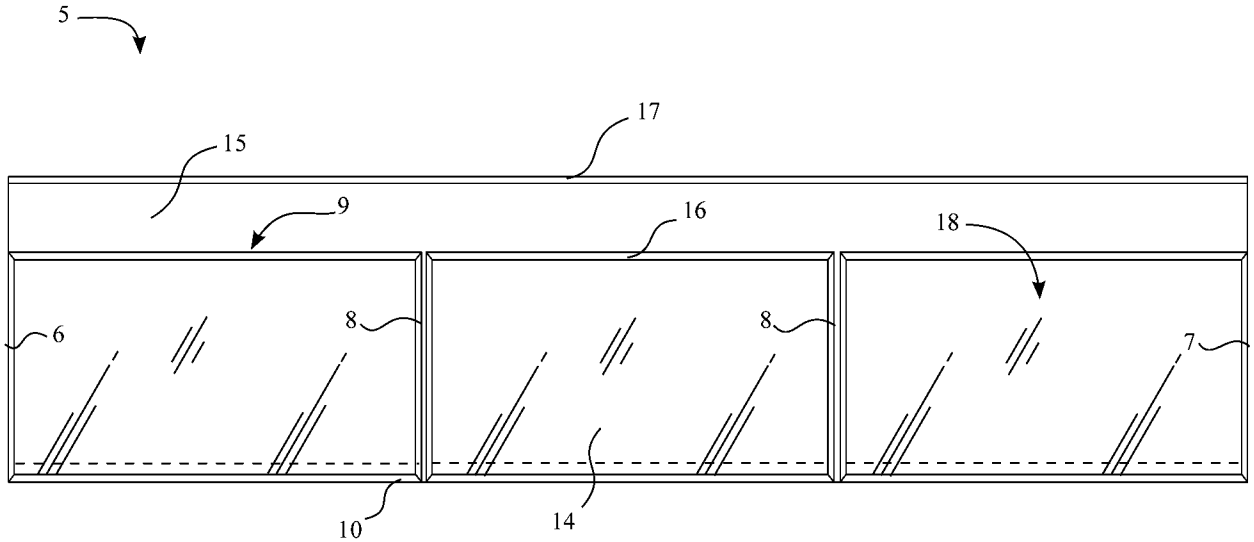
FIG. 8 is a front view of a single pocket strip of the present invention.

As seen in FIG. 1 to FIG. 5, the present invention is a storage sheet having a plurality of pockets. The present invention allows for the containment of objects within for display and organization in a space saving, accessible, and convenient manner. The flexible nature of the present invention allows for the contents to be bundled and secure within a rolled configuration for storage and transport as shown in FIG. 5 to FIG. 7. The present invention comprises a flexible sheet 1, a plurality of pocket strips 4, and a fastener 11. In accordance to FIG. 8, each of the plurality of pocket strips 4 comprises a folded sheet 5, a first outer seal 6, a second outer seal 7, at least one internal seal 8, a plurality of pocket openings 9 and a storage space 18. The flexible sheet 1 comprises a first sheet surface 2 and a second sheet surface 3, which are positioned opposite to each other. The folded sheet 5 comprises a folded edge 10, a front section 14, and a back section 15. The plurality of pocket strips 4 is positioned in a shingled configuration, wherein the plurality of pocket strips 4 overlaps one another. This configuration allows for the contents within each of the plurality of pocket strips 4 to be viewed by the user when the present invention is unrolled. The plurality of pocket strips 4 is evenly distributed along the flexible sheet 1 to facilitate ease of access to the contents placed within the plurality of pocket strips 4. The plurality of pocket strips 4 is connected to the first sheet surface 2. The plurality of pocket openings 9 is positioned opposite of the folded edge 10 to create an accessible orifice for the storage space 18. The placement of the plurality of pocket strips 4 on one side of the flexible sheet 1 allow for the device to be rolled efficiently while keeping the contents of the plurality of pocket strips 4 secure in such a storage or transport configuration. The fastener 11 is operatively mounted onto the flexible sheet 1. The fastener 11 secures the present invention in the rolled configuration.

More specifically, the front section 14 of the folded sheet 5 is folded onto the back section 15 before fixing the front section 14 to the back section 15. In the preferred embodiment of the present invention, the front section 14 is peripherally sealed to the back section 15 using an impulse seal to form the first outer seal 6 and the second outer seal 7. The first outer seal 6 and the second outer seal 7 traverse from the folded edge 10 to the plurality of pocket openings 9 perpendicular to the folded edge 10. The first outer seal 6 and the second outer seal 7 are positioned between lateral perimeter members of the flexible sheet 1 such that the plurality of pocket strips 4 and the contents contained within are protected from abrasive or similar damaging forces. The front section 14 and the back section 15 each comprise a distal edge which is parallel to the folded edge 10. The folded sheet 5 is folded such that the back distal edge 17 is positioned farther from the folded edge 10 than the front distal edge 16 such that they are offset from one another. Consequently, the back distal edge 17 is connected to the flexible sheet 1 such that the plurality of pocket strips 4 hangs from the flexible sheet 1 and is able to be rotated about the plurality of pocket openings 9. The front section 14 is opposite from the flexible sheet 1 with regards to the back section 15. The positioning allows for an easily accessible plurality of pocket openings 9 to be formed opposite the folded edge 10. At least one internal seal 8 is included between the first outer seal 6 and the second outer seal 7 to segment the storage space 18 allowing for the organization of smaller items within the boundaries of the folded sheet 5, the first outer seal 6, the second outer seal 7, and the pocket opening 9. The at least one internal seal 8 is parallel to the first outer seal 6 and the second outer seal 7. Similar to the first outer seal 6 and second outer seal 7, the internal seal 8 traverses perpendicularly from the folded edge 10 to the plurality of pocket openings 9. The plurality of pocket openings 9 is defined by the position of the first outer seal 6, the second outer seal 7, and the internal seal 8.

In an alternate embodiment of the present invention, if the at least one internal seal 8 is two internal seals, the internal seals are positioned equidistant from the first outer seal 6, the second outer seal 7, and the other internal seal 8. Thus, two internal seals delineate a three pocket strip with equal storage space 18. Subsequently, three internal seals delineate four equally sized pocket strips; five internal seals delineate six equally sized pocket strips; etc. In a separate embodiment of a pocket strip, the at least one internal seal 8 being two seals is located at unequal distances from the first outer seal 6, the second outer seal 7, or another internal seal 8, thus delineating a three pocket strip with unequal storage space 18. Similar to the previously mentioned alternate embodiment, three internal seals would delineate a four pocket strip of unequal storage space; four internal seals would delineate a five pocket strip; etc.

Additionally, each of the plurality of pocket strips 4 is positioned in a shingled manner in relation to one another. The plurality of pocket strips 4 comprises an arbitrary strip 19, a preceding strip 20, and a subsequent strip 21. The arbitrary strip 19 overlaps the preceding strip 20 and the subsequent strip 21 overlaps the arbitrary strip 19. The folded edge 10 of the arbitrary strip 19, the preceding strip 20, and the subsequent 21 are parallel to reduce the interference of another strip when connecting the strips to the flexible sheet 1, as well as when accessing the contents of the pocket strips. Having the plurality of strips offset from one another allows for the subsequent strip 21 to be rotated away from the arbitrary strip 19 containing the contents the user wants to access.

Figure 1:
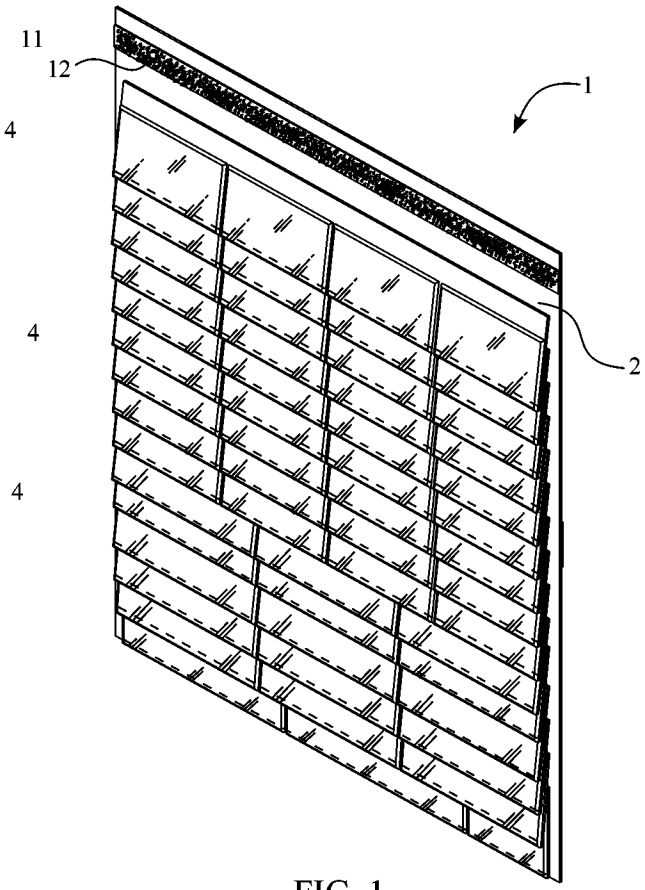
FIG. 1 is a perspective view of the present invention.
Figure 2:
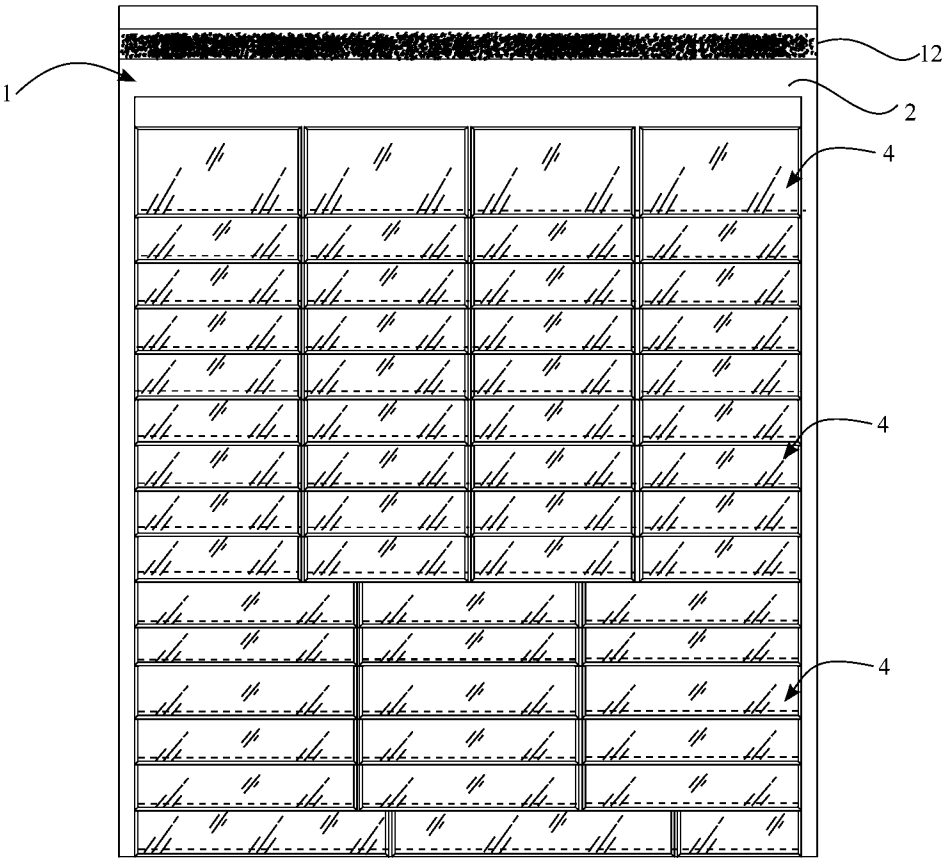
FIG. 2 is a front view of the present invention.
Figure 3:
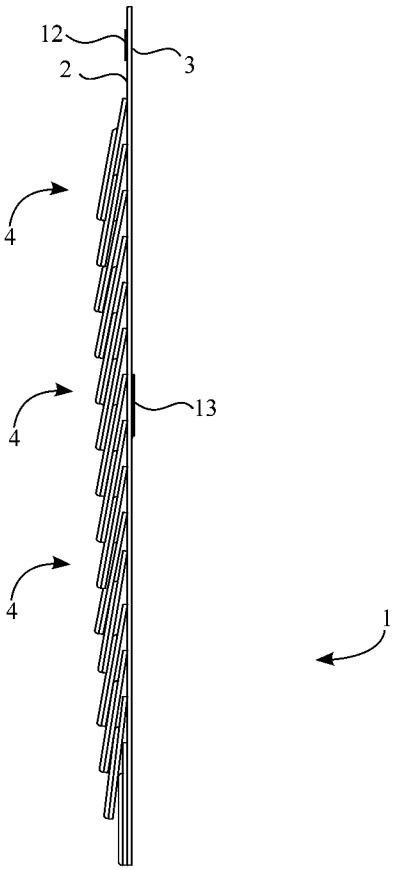
FIG. 3 is a side view of the present invention.
Figure 4:
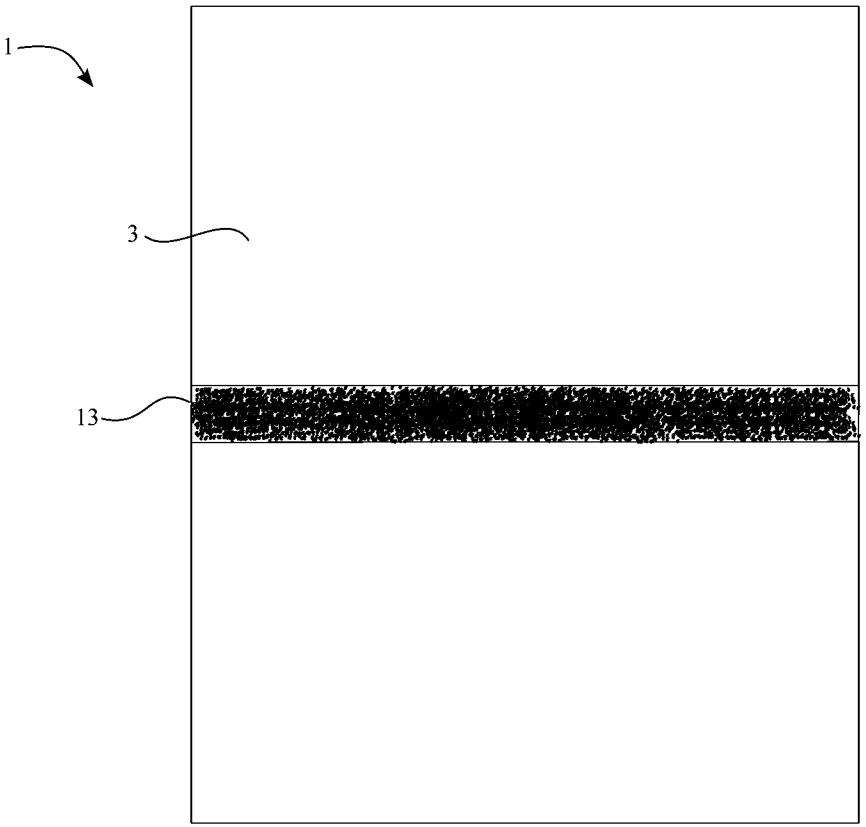
FIG. 4 is a back view of the present invention.

In accordance to FIG. 1 and FIG. 6, the fastener 11 comprises a first interlocking portion 12 and a second interlocking portion 13. The first interlocking portion 12 is connected to the first sheet surface 2 and the second interlocking portion 13 is connected to the second sheet surface 3. When the present invention is arranged in the rolled configuration, the first interlocking portion 12 engages the second interlocking portion 13 to secure the arrangement and the contents held within. The fastener 11, although preferred to be a hook and loop attachment, can also be but not limited to straps, clips, semi-permanent adhesives, or other similar means to secure the present invention in the rolled configuration. In the preferred embodiment using the hook and look fastener, the second interlocking portion 13 is to be wider than the first interlocking portion 12 to allow for the expansion of the roll when the pockets are full, while maintaining the ability to secure the present invention in the rolled configuration.

Additionally, the flexible sheet 1 is made from a heavy duty, densely woven, high-strength nylon fabric with a waxed first sheet surface 2 to provide durable but flexible backing for the plurality of pocket strips 4. The material of the flexible sheet 1 is not limited to heavy duty nylon fabric but may include other nylon fabric, canvas, cloth, or any other flexible and durable material. The plurality of pocket strips 4 is made from a polyvinyl chloride material. The front section 14 is transparent such that the contents of the pocket strips are easily viewed. The material of the plurality of pocket strips 4 is not limited to polyvinyl chloride but may include other polymers, plastics, or any other durable material that is transparent.

In order to manufacture the preferred embodiment of the present invention, first, a Cordura canvas is cut to twenty-two inches by twenty-eight inches, which will be the flexible sheet 1. Next, chalk lines are drawn onto the canvas to mark the location for the placement of the fastener 11 and the plurality of pocket strips 4. Chalk lines placed parallel on the first sheet surface 2 and will be drawn as follows: the first line drawn three quarters of an inch from the top; the second line drawn one inch down from the first line; the third line drawn one inch from the second line; and the fourth through eighteenth line drawn one and half inches from the previous line. On the second sheet surface 3, two chalk lines will be placed; the first chalk line drawn thirteen inches from the top and the second line drawn parallel and two inches from the first. Subsequently, the first interlocking portion 12 is sewn onto the first sheet surface 2 between the first and second chalk lines. The second interlocking portion 13 is then sewn onto the second sheet surface 3 between the two chalk lines. Finally, the plurality of pocket strips 4 is sewn onto the first sheet surface 2. The pocket strips will then be ordered largest to smallest in terms of pocket size and sewn in that order from the chalk line farthest from the first interlocking portion 12 to the nearest, such that the pocket strip having the largest sized pockets is placed at the chalk line farthest from the first interlocking portion 12.

In accordance to the preferred embodiment, each of the plurality of pocket strips 4 is formed through the use of a folded sheet. To manufacture a single pocket strip, a flexible material that is capable of being folded and melted is used. The front section 14 is placed onto the back section 15, creating a folded edge 10. Perpendicular to the folded edge, the material is sealed together using an impulse seal to form the first outer seal 6, the second outer seal 7, and the at least one internal seal 8. Once the seals have been formed, the pocket strip is able to be sewn onto the first sheet surface 2.

Although the invention has been explained in relation to its preferred embodiment, it is to be understood that many other possible modifications and variations can be made without departing from the spirit and scope of the invention as hereinafter claimed.

What is claimed is:

1. A storage sheet having a plurality of pockets comprises:

a flexible sheet;

a plurality of pocket strips;

a fastener;

each of the plurality of pocket strips comprises a folded sheet, a first outer seal, a second outer seal, at least one internal seal, a plurality of pocket openings and a storage space;

the flexible sheet comprises a first sheet surface and a second sheet surface;

the folded sheet comprises a folded edge, a front section, and back section;

the plurality of pocket strips being positioned in a shingled configuration, wherein at least some of the plurality of pocket strips are overlapped by another of the plurality of pocket strips such that overlapping ones of the plurality of pocket strips overlap openings of one or more overlapped ones of the plurality of pocket strips;

the plurality of pocket strips being evenly distributed along the flexible sheet;

the first sheet surface being opposite the second sheet surface;

the plurality of pocket strips being connected onto the first sheet surface such that the overlapping ones of the plurality of pocket strips are configured to be rotated relative to the first sheet surface to allow access to the openings of the overlapped ones of the plurality of pocket strips;

the fastener being operatively mounted onto the flexible sheet;

the plurality of pocket openings being positioned opposite to the folded edge;

the first outer seal and the second outer seal being positioned in between a lateral perimeter of the flexible sheet;

the internal seal being positioned in between the first outer seal and the second outer seal;

the internal seal being positioned parallel the first outer seal and the second outer seal;

the internal seal traversing from the folded edge to the pocket opening;

the internal seal being positioned perpendicular to the folded edge;

the front section being transparent;

the storage space being delineated by the pocket opening, the front section, the back section and the folded edge; and the storage space being segmented by the internal seal.

2. The storage sheet having a plurality of pockets as claimed in claim 1 comprises:

the folded sheet being peripherally sealed to itself by the first outer seal and the second outer seal;

the first outer seal and the second outer seal being positioned opposite to each other across the folded sheet;

the first outer seal and the second outer seal traversing from the folded edge to the pocket opening; and the first outer seal and the second outer seal being positioned perpendicular to the folded edge.

3. The storage sheet having a plurality of pockets as claimed in claim 1 comprises:

the front section comprises a front distal edge in relation to the folded edge;

the back section comprises a back distal edge in relation to the folded edge;

the back distal edge being further from the folded edge than the front distal edge; and the front section and the back section being parallel to the folded edge.

4. The storage sheet having a plurality of pockets as claimed in claim 1 comprises:

the plurality of pocket strips comprises an arbitrary strip, a preceding strip, and a subsequent strip;

the arbitrary strip overlapping the preceding strip;

the subsequent strip overlapping the arbitrary strip; and the folded edge of the preceding strip, the folded edge of the arbitrary strip, and the folded edge of the subsequent strip being parallel to each other.

5. The storage sheet having a plurality of pockets as claimed in claim 1 comprises:

the plurality of pocket openings being delineated by the first outer seal, the second outer seal and the internal seal.

6. The storage sheet having a plurality of pockets as claimed in claim 1 comprises:

the fastener comprises a first interlocking portion and a second interlocking portion;

the first interlocking portion being connected on the second sheet surface; and the second interlocking portion being connected on the first sheet surface.

7. The storage sheet having a plurality of pockets as claimed in claim 1 comprises:

the flexible sheet being positioned in a rolled configuration; and the first interlocking portion being engaged by the second interlocking portion.

8. The storage sheet having a plurality of pockets as claimed in claim 1 comprises:

the plurality of pocket openings being positioned opposite to the folded edge.

9. The storage sheet having a plurality of pockets as claimed in claim 1 comprises:

the first outer seal and the second outer seal being positioned in between a lateral perimeter of the flexible sheet.

10. The storage sheet having a plurality of pockets as claimed in claim 1 comprises:

the front section being transparent.

11. The storage sheet having a plurality of pockets as claimed in claim 1 comprises:

the storage space being delineated by the pocket opening, the front section, the back section and the folded edge; and the storage space being segmented by the internal seal.

12. A storage sheet having a plurality of pockets comprises:

a flexible sheet;

a plurality of pocket strips;

a fastener;

each of the plurality of pocket strips comprises a folded sheet, a first outer seal, a second outer seal, at least one internal seal, a plurality of pocket openings and a storage space;

the flexible sheet comprises a first sheet surface and a second sheet surface;

the folded sheet comprises a folded edge, a front section, and back section;

the plurality of pocket strips being positioned in a shingled configuration, wherein at least some of the plurality of pocket strips are overlapped by other of the plurality of pocket strips such that overlapping ones of the plurality of pocket strips overlap openings of one or more overlapped ones of the plurality of pocket strips;

the plurality of pocket strips being evenly distributed along the flexible sheet;

the first sheet surface being opposite the second sheet surface;

the plurality of pocket strips being connected onto the first sheet surface such that the overlapping ones of the plurality of pocket strips are configured to be rotated relative to the first sheet surface to allow access to the openings of the overlapped ones of the plurality of pocket strips;

the fastener being operatively mounted onto the flexible sheet;

the front section comprises a front distal edge in relation to the folded edge;

the back section comprises a back distal edge in relation to the folded edge;

the back distal edge being further from the folded edge than the front distal edge;

the front section and the back section being parallel to the folded edge;

the fastener comprises a first interlocking portion and a second interlocking portion;

the first interlocking portion being connected on the second sheet surface;

the second interlocking portion being connected on the first sheet surface;

the plurality of pocket strips comprises an arbitrary strip, a preceding strip, and a subsequent strip;

the arbitrary strip overlapping the preceding strip;

the subsequent strip overlapping the arbitrary strip;

the folded edge of the preceding strip, the folded edge of the arbitrary strip, and the folded edge of the subsequent strip being parallel to each other;

the folded sheet being peripherally sealed to itself by the first outer seal and the second outer seal;

the first outer seal and the second outer seal being positioned opposite to each other across the folded sheet;

the first outer seal and the second outer seal traversing from the folded edge to the pocket opening;

the first outer seal and the second outer seal being positioned perpendicular to the folded edge;

the internal seal being positioned in between the first outer seal and the second outer seal;

the internal seal being positioned parallel the first outer seal and the second outer seal;

the internal seal traversing from the folded edge to the pocket opening;

the internal seal being positioned perpendicular to the folded edge; and the plurality of pocket openings being delineated by the first outer seal, the second outer seal and the internal seal.

13. The storage sheet having a plurality of pockets as claimed in claim 12 comprises:

the flexible sheet being positioned in a rolled configuration; and the first interlocking portion being engaged by the second interlocking portion.

14. A fishing lure holder comprising:

a flexible sheet having a first sheet surface, a second sheet surface opposite the first sheet surface, a top and a bottom;

a fastener comprising a first interlocking portion positioned on the second sheet surface and a second interlocking portion positioned on the first sheet surface, the first and second interlocking portions positioned to engage one another when the flexible sheet is in a rolled up position;

a plurality of pocket strips attached to the first sheet surface of the flexible sheet, each of the plurality of pocket strips having a top portion, a bottom portion, a transparent front portion between the top portion and the bottom portion, and a plurality of laterally spaced openings into the front portion allowing access to a plurality of storage spaces formed under the transparent front portion;

wherein the top portion of each of the pocket strips is attached to the flexible sheet at one of a plurality of locations spaced apart between the top and bottom of the flexible sheet such that the plurality of pocket strips are arranged in a shingled configuration with the bottom portions of at least some of the pocket strips overlapping the openings and a part but not all of the transparent front portions of one or more lower pocket strips, and such that the pocket strips overlapping the openings of the one or more lower pocket strips are configured to be rotated relative to the flexible sheet to allow access to the openings of the one or more lower pocket strips.

15. The fishing lure holder as claimed in claim 14, wherein the plurality of pocket strips comprises an arbitrary strip, a preceding strip, and a subsequent strip, and wherein the arbitrary strip overlaps the preceding strip and the subsequent strip overlaps the arbitrary strip.

16. The fishing lure holder as claimed in claim 15, wherein for each of the plurality of pocket strips, the plurality of laterally spaced openings into the front portion are delineated by a first outer seal, a second outer seal and at least one the internal seal.

* * * * *